US006558302B2

(12) United States Patent
Cluff

(10) Patent No.: US 6,558,302 B2
(45) Date of Patent: May 6, 2003

(54) MUSCLE TRAINING AND DEVELOPMENT DEVICE

(76) Inventor: David H. Cluff, 2505 E. Desert La., Gilbert, AZ (US) 85234

( * ) Notice: Subject to any disclaimer, the term of this patent is extended or adjusted under 35 U.S.C. 154(b) by 55 days.

(21) Appl. No.: 09/783,369

(22) Filed: Feb. 14, 2001

(65) Prior Publication Data

US 2002/0111253 A1 Aug. 15, 2002

(51) Int. Cl.[7] ..... A63B 21/04; A63B 69/36

(52) U.S. Cl. ..... 482/129; 482/139; 482/904; 473/229

(58) Field of Search ..... 482/139, 904, 482/129, 44, 49, 51, 109, 122, 123, 126, 130; 473/229

(56) References Cited

U.S. PATENT DOCUMENTS

| | | | | |
|---|---|---|---|---|
| 605,237 | A | | 6/1898 | Spink |
| 1,112,114 | A | | 9/1914 | Caines |
| RE14,618 | E | | 3/1919 | Chanaud |
| 2,848,234 | A | | 8/1958 | Brandon |
| 3,083,016 | A | | 3/1963 | Sumegi |
| 3,618,942 | A | | 11/1971 | Bates |
| 3,677,546 | A | | 7/1972 | Richardson |
| 3,738,661 | A | | 6/1973 | Moller |
| 4,328,964 | A | | 5/1982 | Walls |
| 4,449,708 | A | * | 5/1984 | Humphrey ..... 273/186 |
| 5,007,635 | A | | 4/1991 | Tiller |
| 5,040,788 | A | | 8/1991 | Randall |
| 5,250,016 | A | | 10/1993 | Higgins |
| 5,288,073 | A | * | 2/1994 | Noel ..... 273/186.1 |
| 5,431,617 | A | | 7/1995 | Rattray, Jr. |
| 5,476,257 | A | | 12/1995 | Bobby |
| 5,478,079 | A | | 12/1995 | Liberatore et al. |
| 5,538,251 | A | | 7/1996 | Harper |

* cited by examiner

*Primary Examiner*—Jerome W. Donnelly
*Assistant Examiner*—Victor Hwang
(74) *Attorney, Agent, or Firm*—Schmeiser, Olson & Watts LLP

(57) ABSTRACT

A golf development and training device has first and second rods detachably connected at first and second connection points. Both rods contain multiple apertures for the receipt of one hooked end of a stretchable or elastic tube. The rods define a space between them when they are connected. A grip slidably engages the first rod and audibly clicks as it slides against the second rod when certain critical aspects of the training motion are correctly performed. At least one elastic tube is connected between the rod assembly and an attachment device which is secured to a stationary object that provides resistance and support. The attachment device includes vertical and horizontal rows of attachment apertures that receive the other end of the elastic tube. Multiple elastic tubes may be used, the number of which is dictated by the level of resistance desired during any particular exercise or training movement.

15 Claims, 6 Drawing Sheets

MUSCLE TRAINING AND DEVELOPMENT DEVICE

BACKGROUND OF THE INVENTION

1. Technical Field

This invention is a muscle training and development device. More particularly the device may be used to exercise and train the muscles used in various sports-related motions with an emphasis on training the muscles of the golf swing.

2. Background Art

As the popularity of athletic and other physical pursuits increases, so does the popularity of training devices intended to develop one's ability to perform those pursuits with greater skill and success. Because all physical pursuits by definition utilize, to varying degrees, the muscles of the body, many such training devices focus on the development of the muscles and muscle groups important in a particular activity.

Many of these muscle development devices operate by providing resistance against which the muscles work. This strengthens and enlarges the muscles and increases their ability to act against that resistance. Another category of muscle development device seeks to train a particular muscle or group of muscles to perform a certain motion in a consistent, uniform manner. For example, baseball pitchers would benefit from developing the wrist, arm, and shoulder muscles to withstand the strain placed on them by the pitching motion. Pitchers, therefore, seek ways to train those muscles to perform the throwing motion consistently so as to allow accuracy in ball placement and movement. Golf is another physical activity in which strength and control are important. Golfers benefit from developing the muscles of the arms, shoulders, wrists, torso, and legs, all of which directly affect the golf swing. In addition, golfers benefit from training those muscles to perform consistently and uniformly every time the golf swing is attempted.

There are a number of devices available that seek to develop and/or train the muscles used in almost any sport or physical activity, and this is certainly true for the game of golf. Golf training devices exist in many forms, and each device approaches the task in its own way. Almost all of the existing golf training devices, as might be expected, are designed to work within the context of a sweeping arm motion that imitates an actual golf swing. The structure and function of the actual devices, however, vary widely. Many do not address the issue of proper wrist position and movement, while others ignore the need to assist with flexibility. Many training devices do not force a user's swing motion to stay in the proper plane.

Currently, there is no single golf training device that addresses all of the aspects of golf swing development mentioned above. There are several that perform some of the important functions, but all are lacking one or more features that are critical to the development of a consistent and powerful golf swing. Over the years exercises have been developed for every muscle in the body. The problem encountered with these devices, however, is that in sports especially, the various muscle groups work together in a synergistic manner to produce the desired result. Exercising individual muscles or even muscle groups, therefore, does not yield the desired results. In fact, otherwise effective muscle building or training exercises can actually be detrimental to the performance of a particular athletic movement. This detrimental effect can occur if even one muscle is ignored or over developed so that multi-muscle synergy is not optimized.

DISCLOSURE OF INVENTION

As indicated, there existed a need to provide a golf training device that simultaneously teaches a golfer the correct swing plane with proper arm and wrist movement while also increasing the flexibility and strength of the muscles employed in the golf swing so that all the elements of a good swing work together. The present invention is such a golf development and training device.

The device has first and second rods detachably connected at first and second connection points. Both rods contain multiple apertures for the receipt of one end of a stretchable latex tube. The rods define a space between the tubes when they are connected. The first rod is called the grip rod. Attached to this rod is a plastic sleeve which slides and allows the grip to move during critical exercise and training movements. The rotation feature of the plastic grip sleeve during certain movements allows the grip rod and the attached tubes to remain stable and stay on the same plane without binding or affecting the fluidity of the training movement. The sliding feature of the plastic grip sleeve is a vital aspect of the design in that as it slides and engages the second rod (or the bent rod) there is an audible click so that when swing movement is performed correctly, the user not only feels the grip slide into position, but hears the confirming click. This feedback is an invaluable part of the training process, because as explained herein, the slide and the click signal that certain important arm and wrist movements have been properly made.

In use, at least one elastic band is connected between the rod assembly and an attachment device which is secured to a doorway or trimmed end wall to provide resistance and support as exercises are performed. The attachment device includes a vertical and a horizontal row of apertures that receive the elastic tubes. Here, the vertical and horizontal directions are taken with respect to level ground, horizontal meaning substantially parallel to the ground and vertical meaning substantially perpendicular to it.

The training device can be used for multiple purposes, including the training of muscles for multiple sports and activities. It is well suited to develop the wrist, arm, shoulder, and torso muscles used heavily in golf, tennis, racquetball, and baseball. The following discussion will focus on its use in terms of golf training, but it should be understood that the device can be used to advantage in the context of almost any activity that requires repetitive, controlled, or forceful movement of the muscles of the upper body and even the lower body and legs.

For golf training one or more elastic tubes are attached to the apertures at the end of the grip rod. The other end of the tube or tubes is then attached to the attachment device which is already secured to a doorway or a trimmed end wall as pictured herein. The user then stands at a requisite distance from the attachment device so that there is a desired tension in the elastic sufficient to allow the swing exercise to be optimally performed. The more tension in the elastic tubes the greater will be their resistance to the exercise.

The user also stands at a proper angle to the attachment device so that the elastic tube as it stretches from the attachment device to the grip rod establishes the appropriate swing plane on which the swing exercise will be performed. Standing so that the attachment device is approximately one pace behind the user and to his right (if the user is right handed) places the user in an ideal position to perform the golf swing exercise in the proper plane. In this position the tension from the tubes themselves helps to keep the user's swing on plane as he attempts to follow through on the line established by the partially stretched tube(s) at the outset.

During the exercise the grip on the grip rod is grasped like a golf club and a golf swing is made against the resistance of the tube and on the line established by the tube as it stretches out from the attachment device when the user is in the starting position with the grip rod device as previously explained. The up and back portion of the swing is made in similar fashion to the usual golf back swing. When the user is in the proper position at the top of the swing with his dominant wrist appropriately cocked and set, the plastic grip sleeve will slide up slightly and audibly click against the bent rod signaling that the correct back swing position has been obtained. This slide and click feedback is critically important to the golfer's ability to find that elusive "slot" at the top of the swing. Finding the proper position or "slot" at the "top" is crucial to the correct execution of the all-important forward swing.

The forward swing is carried down and through on the established line just as one would execute a normal forward swing in golf. During exercise and training this forward swing is only carried through to a position slightly past where the ball would be expected to be positioned in an actual golfing situation. The swing exercise is completed only when the wrists are fully uncocked and driven just past but through the imaginary point of impact with a hammering type action. Because of the resistance provided by the elastic tubes the wrists are pulled back in an ideal cocked position. To release them through, however, takes a considerable effort. The effort required depends upon the tension established by the initial stance distance from the attachment device and the number of tubes being used. The user knows he has completed the swing and accomplished the proper hammer-like release when he again feels the grip sleeve slide down slightly on the grip rod and hears the audible click as it impacts the bent rod. Once again this slide and click feedback is an invaluable part of training the golfer to correctly use the tremendously powerful hammering of his wrists in executing the golf swing.

The slide and click feature which offers dramatic feedback to the user at both the top and the bottom of the swing is critically important to the exercise and training of the hands and wrists in performing the correct golf swing. This vital feature is not found in any of the devices defined or envisioned by the prior art.

The bent rod can also be placed between the arms as they grip the swing device. This accomplishes two important things. It assists in keeping the hands and wrists in proper relation to one another during the grip and swing exercise, thus training the proper grip for actual golf. This important feature is also completely unique and is absent in the prior art. In addition, keeping the bent rod between the hands helps to keep the grip rod on plane in relation to the attached tubes during the swing exercise.

The device allows focus on different portions of the swing which can be practiced independently. The attachment device is also moveable so that it can be adjusted to the height of each user. It is recommended that most of the golf swing exercises be performed with the attachment device secured at the user's eye level. This customizing adaptable feature of the device and attachment mechanism also sets it apart from any prior art.

The foregoing and other features and advantages of the invention will be more apparent from the following description of certain embodiments of the invention, as illustrated in the accompanying drawings.

BRIEF DESCRIPTION OF DRAWINGS

Various embodiments of the present invention will hereinafter be described in conjunction with the appended drawings, where numbered designations denote key elements.

MODES FOR CARRYING OUT THE INVENTION

The swing device portion of the present invention has first and second rods detachably connected at first and second connection points. Both rods contain multiple attachment apertures for the receipt of one end of a stretchable elastic tube. The rods define a space between them when they are connected. A plastic sleeve around which is placed a soft rubber grip is place over the first rod so that the sleeve and grip are allowed to rotate around and slide up and down on the straight grip rod. The movement of the sleeve and the audible click created during certain key portions of the exercise signal to the user that the exercise swing has been performed correctly. This not only teaches proper technique but focuses the exercise on strengthening the most important muscles of the correct golf swing. When used, at least one elastic tube is connected between the swing device and the attachment device. The attachment device is secured to a doorway or other trimmed end wall which provides resistance and support. The attachment device also includes vertical and horizontal rows of attachment apertures that receive the elastic tubes.

Figure 1:
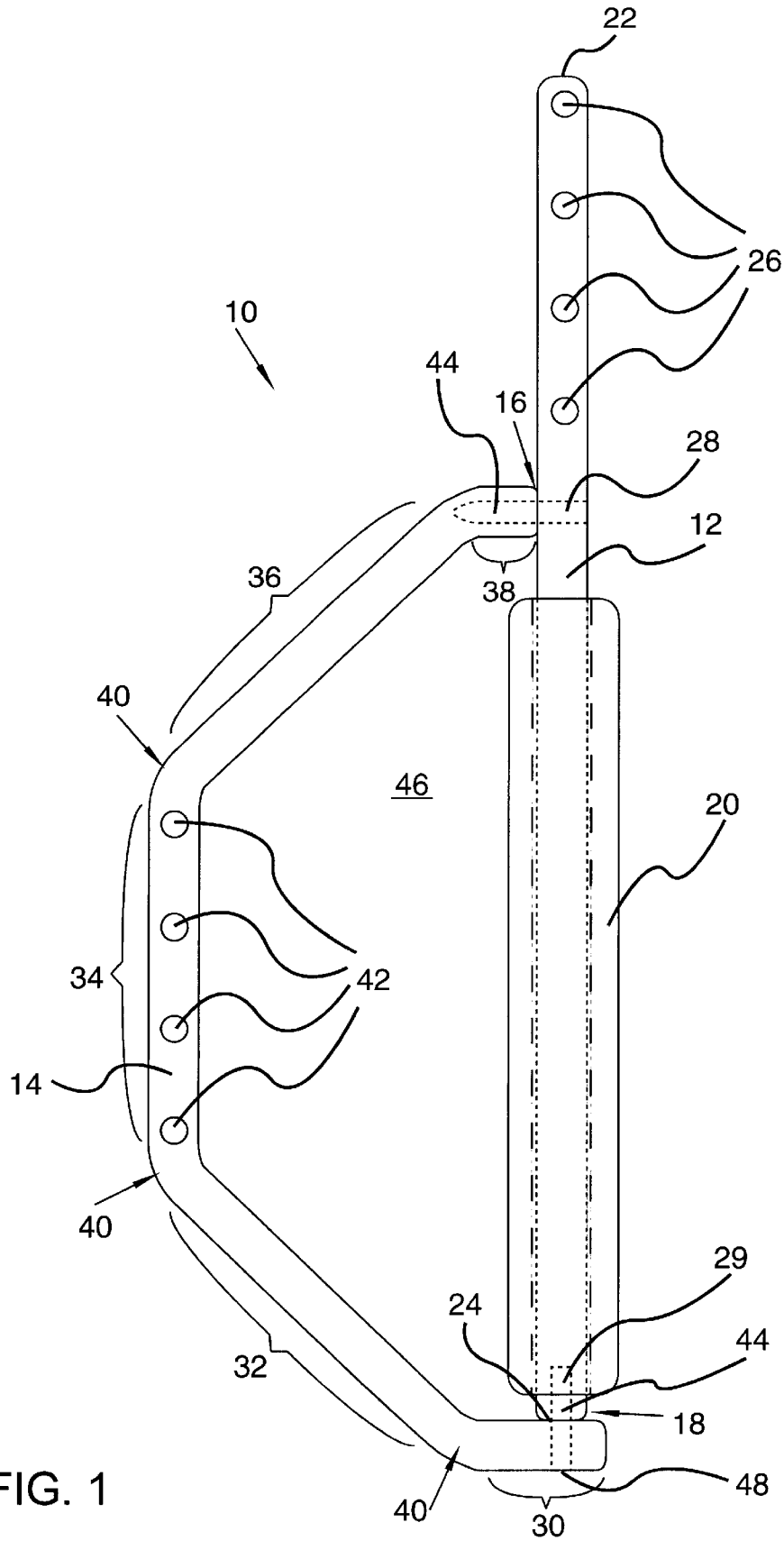
FIG. 1 is a top view of the swing device portion showing one embodiment of the invention.

Referring now to FIG. 1, the golf training swing device 10 has a first rod 12 and a second rod 14 connected at a first connection point 16 and a second connection point 18. A grip 20 is attached to a plastic sleeve which slides over the first rod 12 so that it can rotate on the first rod and can slide freely between first and second connection points 16 and 18. First rod 12 has a first end 22 and a second end 24. First rod 12 is substantially straight and smooth and contains a first plurality of apertures 26 near first end 22. First rod 12 further contains first connection aperture 28 located at first connection point 16 and second connection aperture 29 located at second connection point 18.

Second rod 14 comprises a first section 30, a second section 32, a third section 34, a fourth section 36, and a fifth section 38. Sections 30, 32, 34, 36, and 38 are substantially straight segments of second rod 14 separated by elbows 40. Sections 32, 34, and 36 are of substantially equal length. Section 30 is substantially shorter, and section 38 is slightly shorter still. Section 30 covers and extends beyond end 24 of the first rod 12 as shown in FIG. 1. Section 34 contains the a second set of apertures 42. Fastening devices 44 extend through connection apertures 28 and 29 in first rod 12 and into second rod 14.

First and second rods 12 and 14 define a space 46 which is between them when they are connected to each other at connection points 16 and 18 with fastening devices 44. Second rod 14 may be removed from first rod 12 so that grip 20 may be replaced if needed. Grip 20 will be a sleeve which may be constructed of plastic, and covered with a cushioning material such as foam rubber for the user's comfort and to promote a firm solid non-slip grip surface. Rods 12 and 14 are preferably constructed of a durable metal such as steel. As the plastic and the foam rubber endure prolonged gripping, sliding and striking contact with the steel rods they may eventually wear out, making their replacement desirable.

Figure 2:
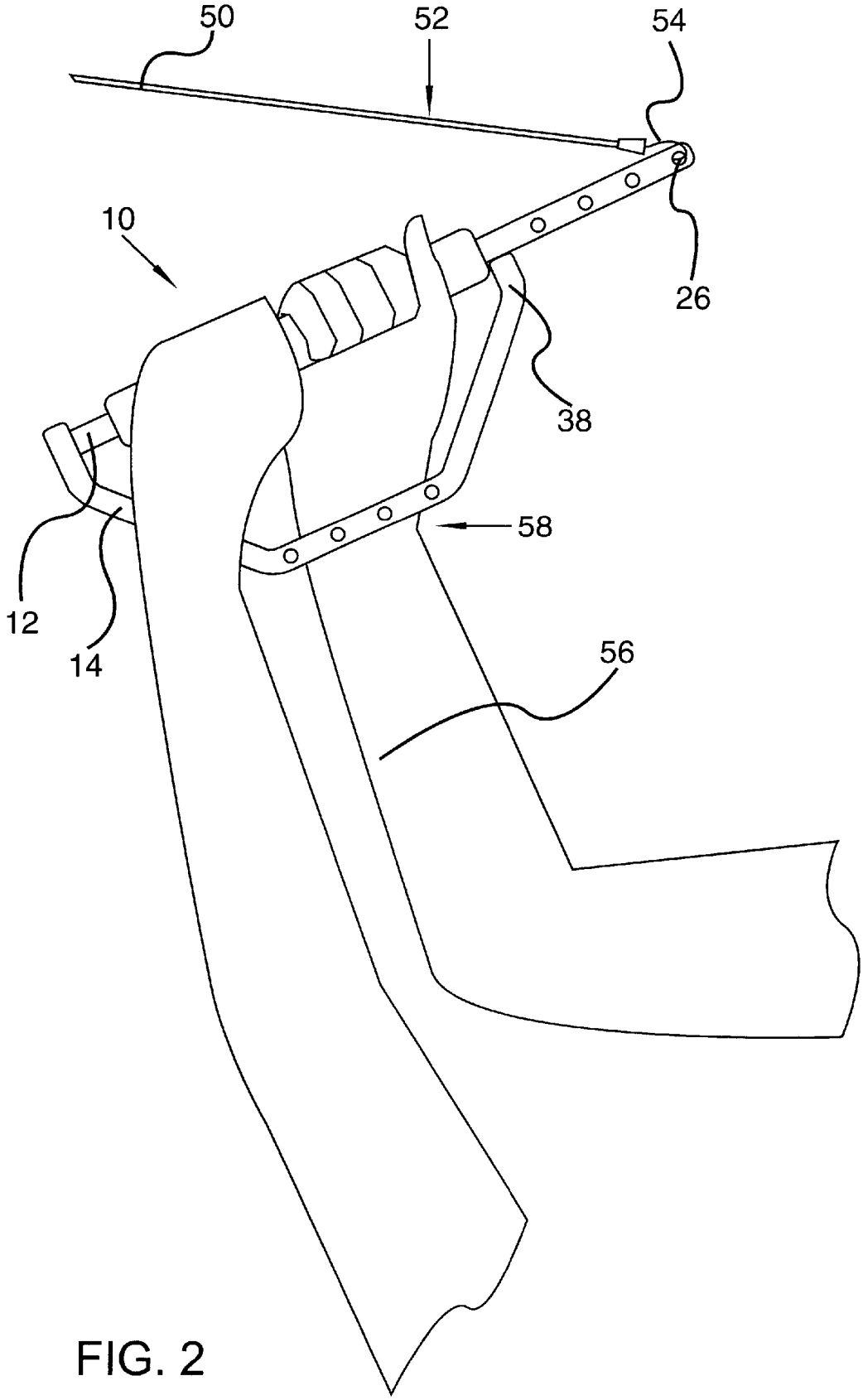
FIG. 2 is a perspective view of the swing device portion at the top of the swing.

Referring now to FIGS. 1 and 2, the first set of apertures 26 and the second set of apertures 42 may selectively receive a first end 52 of an elastic tube 50. One or more elastic tubes 50 may be used, depending on the desired resistance and difficulty level. Any one or any combination of apertures 26, or, alternatively, of apertures 42, may be used. Apertures 26 selectively receive first end 52 of elastic tube 50 when a particular set of exercises are to be performed. When a different set of exercises are desired, apertures 42 are selectively used as the attachment location for first end 52 of elastic tube 50. The nature of these exercises will be more fully discussed below.

Apertures 26 and 42 advantageously extend completely through first rod 12 and second rod 14, respectively. This construction provides for a more stable and secure coupling between rods 12 and 14 and elastic tube 50 than would apertures bored only partially through rods 12 and 14. The coupling is accomplished by a metal hook 54 or similar device fastened to the first end of each elastic tubes 50. Any other coupling device capable of establishing a secure connection between apertures 26 or 42 and elastic tubes 50, such as clamps, screws, or ties, may also be used. Both apertures 26 and apertures 42 may in one embodiment of golf training swing device 10 be separated by spaces of substantially equal size, although the spacing may also be irregular. Adequate spaces between apertures 26 and 42 help prevent tangling or rubbing of elastic tubes 50 in the event multiple elastic tubes 50 are used. Apertures 26 and 42 need not all be centered on parallel axes, although the parallel axis relationship can be advantageous in the sense that it allows a uniform tension in elastic bands 50 when more than a single band 50 is used. In one embodiment, training device 10 has four apertures 26 and four apertures 42. However, any other number of apertures 26 and 42 may be used, limited only by the space constraints imposed by the lengths of first rod 12 and section 34 and the width of the hooks 54 and elastic tubes 50.

In the illustrated embodiment of training device 10, apertures 26 are located substantially along the same line on the surface of first rod 12 and extend through first rod 12 along parallel axes that are each perpendicular to the long axis of first rod 12. First connection aperture 28 extends through first rod 12 in a direction perpendicular to the parallel axes of apertures 26, with entry and exit points on the surface of first rod 12 located roughly 90 degrees from the entry and exit points of apertures 26. Second connection aperture 29 is centered on the long axis of first rod 12 and enters first rod 12 substantially in the middle of second end 24. Second connection aperture 29 does not extend all the way through first rod 12, but its depth is sufficient to receive the length of fastening device 44. Fastening device 44 enters second rod 14 at third connection aperture 48.

First connection aperture 28 penetrates section 38 of second rod 14 and extends into section 38 in a direction parallel to its long axis and to a distance sufficient to receive the length of fastening device 44. Second connection aperture 29 extends into and through first section 30 of second rod 14 perpendicularly to the long axis of first section 30. To secure first and second rods 12 and 14 to each other a fastening device 44 is inserted through second connection aperture 29 in second rod 14 and into first rod 12 at second end 24 and then tightened. A different fastening device 44 is similarly inserted into first connection aperture 28 in first rod 12 and into fifth section 38 of second rod 14 and tightened.

Referring again to FIG. 2, golf training swing device 10 is attached to elastic tube 50 at one of first training device apertures 26. Elastic tube 50 attaches to first rod 12 at first end 52. Second end 78 of elastic tube 50 and attachment mechanism 60 are not shown in FIG. 2 but serve to maintain tension in elastic tube 50 when training device 10 is positioned as shown. Arms 56 are here raised substantially as they would be at the top of the backswing portion of a golf swing.

This portion of the training exercise illustrated in FIG. 2 proceeds as follows. The user stands as he would prior to a normal golf swing and grasps grip 20 in a comfortable manner. The grasp shown in FIG. 2 is only one of several possible grasps. The manner of grasp chosen will depend on the exercise being performed as well as on personal preference and comfort. For example, the hands may be placed on the grip 20 so that second rod 14 is between the wrists 58. Grasped in that way, training device 10 offers important tactile feedback to the user regarding the correct positioning of hands and wrists 58 in the proper golf swing.

Figure 4:
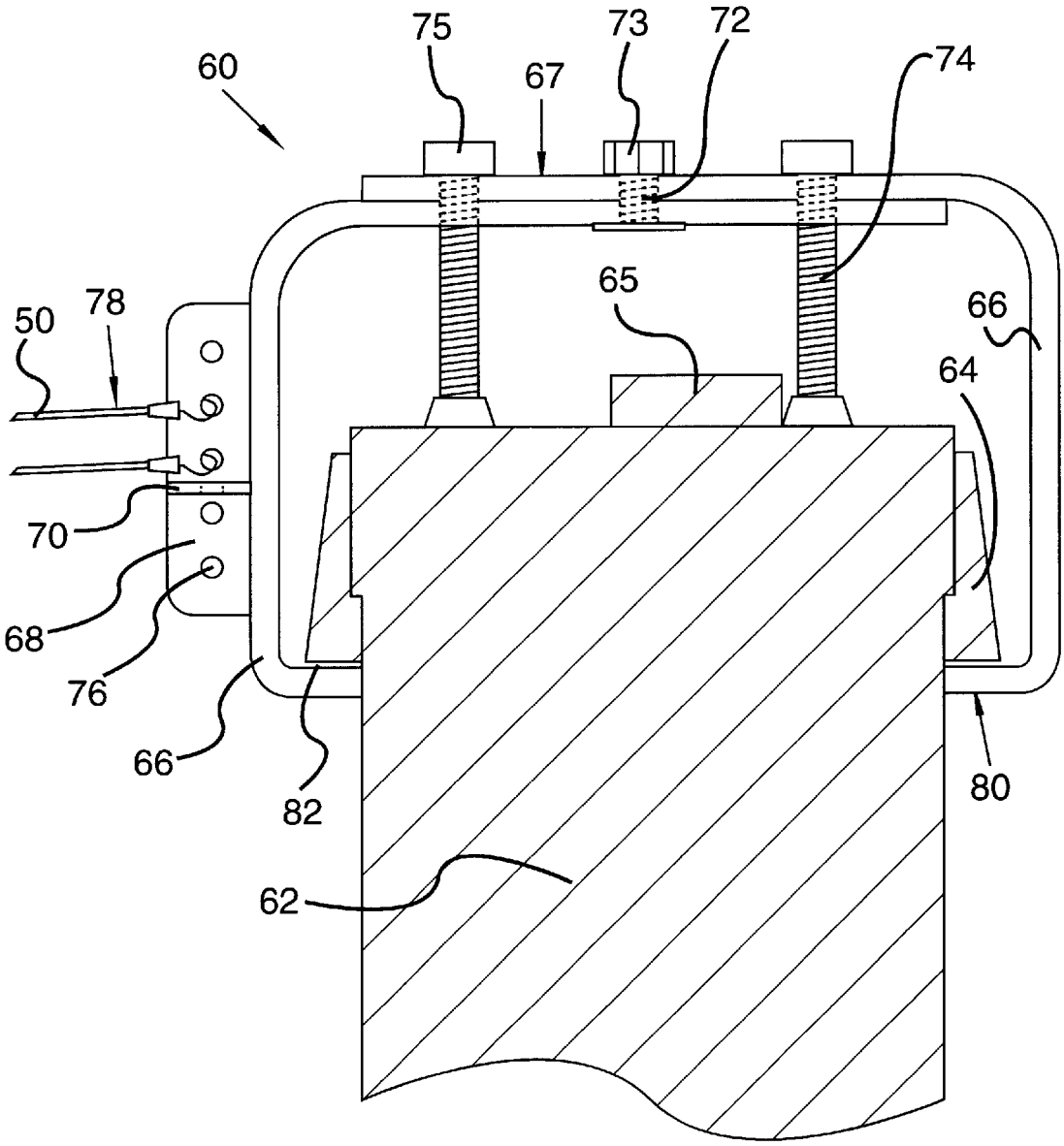
FIG. 4 is a top view of one embodiment of the attachment mechanism.

When using the device pictured in FIG. 2, the user attaches elastic tube 50 to attachment device 60 which is also attached to a stationary object such as a doorframe 64 or the trimmed out end of a wall 62, as shown in FIG. 4. The attachment mechanism 60 and the method of attachment will be further explained in connection with FIG. 4. The user stands far enough from the wall that the slack in elastic tube 50 is removed, but not so far as to stretch elastic tubed 50 to its limit. In other words, the user stands at a distance from the wall 62 so that the elastic tube 50 does not droop or sag between the first end 52 and second end 78 yet at the same time still has plenty of stretch available to perform the desired exercise. Elastic tube 50 will typically extend out and away from the user's shoulder in a direction perpendicular to and slightly behind the direction the user is facing. It should be remembered that multiple elastic tubes 50 may also be used if greater resistance is desired.

From this initial stance arms 56 may be raised to the backswing position pictured in FIG. 2. Wrists 58 must be properly cocked at the top in order to practice and exercise the proper swing. When the correct wrist position is achieved, grip 20 slides into section 38 of second rod 14 with an audible click. Training device 10 may then be brought down out of the backswing position in just the same way that a real golf club would be swung. Elastic tube 50 pulls on training device 10 in such a way as to contain the downswing in the proper plane, and the user's muscles are thereby trained in the feel and motion needed for a proper swing.

Figure 3:
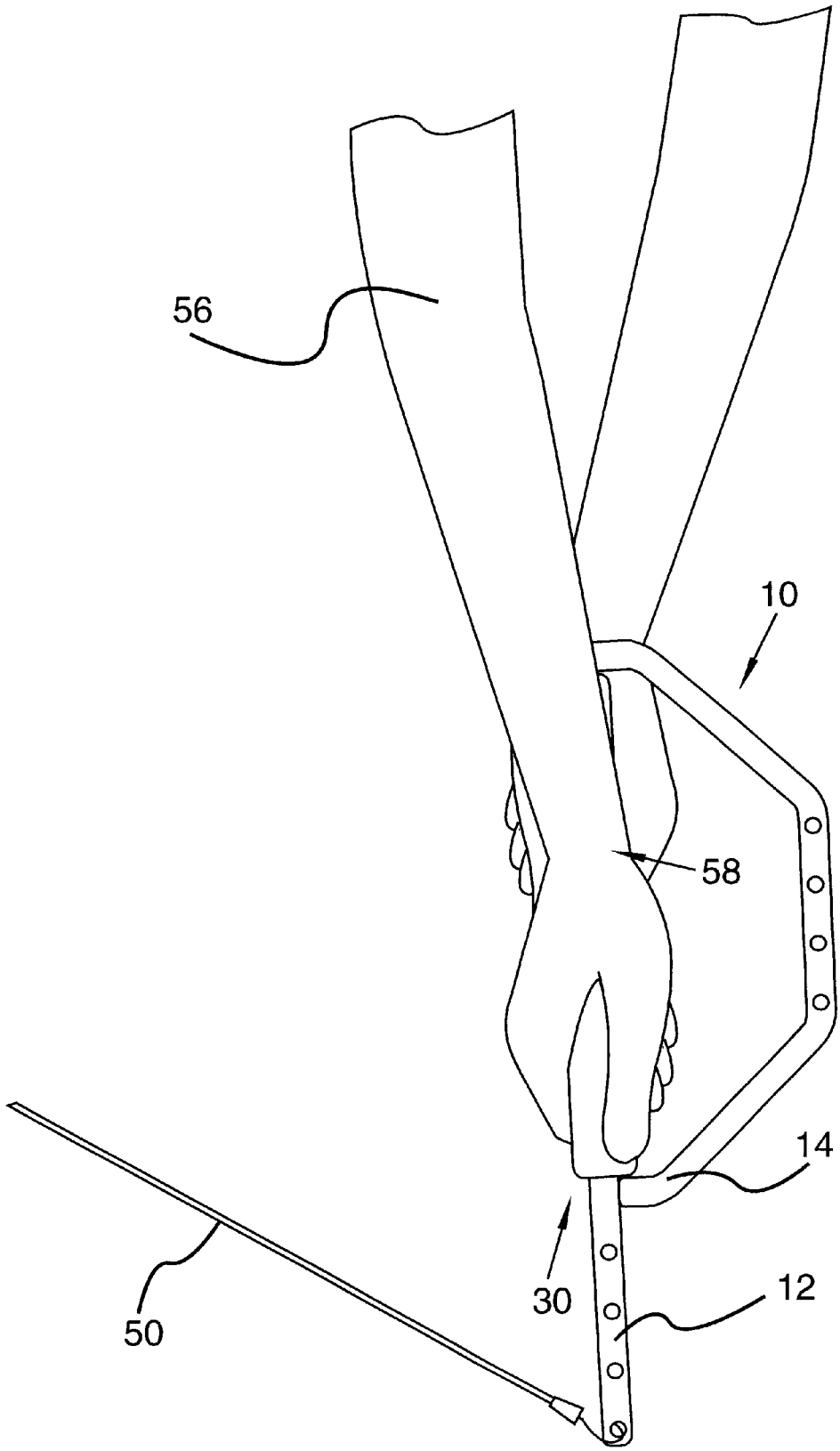
FIG. 3 is a perspective view of the swing device portion at the bottom of the swing.

Referring now to FIG. 3, arms 56 have been swung into what will be referred to as the contact position, meaning the position arms 56 would occupy when holding a golf club as it struck a golf ball. Although no golf ball is used in connection with golf training device 10, the exercises which training device 10 makes possible are helpful in part because they guide the user's body into the position it should be in when swinging an actual golf club in a real game of golf.

A proper back swing requires the wrists 58 to be cocked in a particular way as has already been described in connection with FIG. 2. In similar fashion, wrists 58 must be released as they approach the critical moment of contact shown in FIG. 3. When this hammer like release of wrists 58 is properly accomplished, grip 20 slides slightly to contact section 30 of second rod 14 with an audible click. FIG. 3 shows grip 20 in contact with first section 30 as described.

Elastic tube 50 is kept taut through most of the exercise described in connection with FIGS. 2 and 3. This helps to guide the swing into the proper plane, as mentioned above, and works to develop and strengthen the muscles used in the golf swing. A further advantage of golf training device 10 is that its use tends to increase the flexibility of the user's body. Because the training motion practiced with device 10 so closely replicates many movements in a real golf swing, flexibility is created in the important muscles and joints used in a real golf swing.

The foregoing exercise is typically performed with both hands on grip 20 in the same fashion that a golf club would be grasped during a golf swing. This posture, however, more greatly benefits the muscles of the user's dominant arm—the right arm for a right-handed user—at the expense of the muscles of the user's other arm. To compensate for this and emphasize the non-dominant arm, a user may use device 10 in an alternate configuration in which elastic tube 50 is attached to device 10 at apertures 42. This changes the resistance provided by elastic tube 50 in such a way that the non-dominant arm is able to take the lead in performing the proper swing motions and increase in strength and flexibility while the user gets the feedback discussed above. Although both arms 56 grasp grip 20 in this configuration as in the configuration previously described, the muscles of the non-dominant arm are emphasized.

Referring to FIG. 4, an attachment mechanism 60 is attached to a wall 62 at a doorframe or trimmed end wall 64. For most swing exercises it is advantageous to secure attachment mechanism 60 to a point on wall 62 that is roughly at the eye level of the user. Attachment mechanism 60 includes arms 66 with arm extensions 80, a horizontal attachment bar 68, a vertical attachment bar 70, a width adjuster 72, and tighteners 74. Width adjuster 72 is further distinguished from tighteners 74 by the vertical lines drawn on the head 73 of width adjuster 72. Heads 75 of tighteners 74 do not have these lines. The sole purpose of these lines in the illustration is to differentiate width adjuster 72 from tighteners 74.

Horizontal attachment bar 68 has attachment apertures 76 which selectively receive a second end 78 of elastic tube 50. Horizontal attachment bar 68 may be a lip or flange that is molded from the same piece of material as is used for arms 66. Horizontal attachment bar 68 may be bent or folded out from the main body of attachment mechanism 60, thus providing an easily accessible location at which to attach the ends of elastic tubes 50. Vertical attachment bar 70 extends up and out of horizontal attachment bar 68. Arms 66 are designed to slide so that the width of the attachment mechanism 60 can be adjusted. Because the arms 66 slide with respect to each other they contain slots for the passage of tighteners 74 rather than having simple holes for that purpose. Tighteners 74 are inserted through these slots and are free to move along the slots as required by the particular configuration of wall, doorway, etc. to which the attachment mechanism is to be secured.

Width adjuster 72 operates to increase and decrease, as needed, the distance between arm extensions 80. The width adjuster 72 is a screw that is tightened when the width is appropriate between the arm extensions 80. Setup of attachment mechanism 60 proceeds generally as follows. The distance between arm extensions 80 is increased, using width adjuster 72, until arms 66 can fit around wall 62 and doorframe trim 64. The following discussion will assume a doorframe 64 is present as opposed to merely a trimmed end wall. Arm extensions 80 are placed around doorframe 64 and width adjuster 72 is tightened when the arm extensions 80 and arms 66 are pulled together to fit snugly around wall 62. Tighteners 74 are then manipulated so as to force surface 67 away from wall 62, thus closing a gap 82 and creating a substantial amount of pressure between surface 67 and arm extensions 80. This pressure is what secures attachment mechanism 60 to wall 62. It should be noted that tighteners 74 may slide to various positions along the slot in arms 66 in order to avoid lining up with protrusion 65 of doorframe 64.

It has already been stated that the number of elastic tubes 50 used in conjunction with training device 10 may vary. For low levels of resistance a single tube 50 may be used. When increased resistance is desired multiple bands 50 may be attached. When training device 10 is used as a golf swing trainer as illustrated in FIGS. 2 and 3, vertical wall attachment apertures 84 are appropriately used. When device 10 is used as a resistance trainer as illustrated in FIG. 6, horizontal attachment apertures 76 may be used instead. The reason for the alternate configurations has to do with the primary orientation of elastic tubes 50 for the exercises performed. The golf swing training exercise of FIGS. 2 and 3 involves motion in a generally vertical plane while the resistance exercise of FIG. 5 involves motion in a generally horizontal plane.

Figure 5:
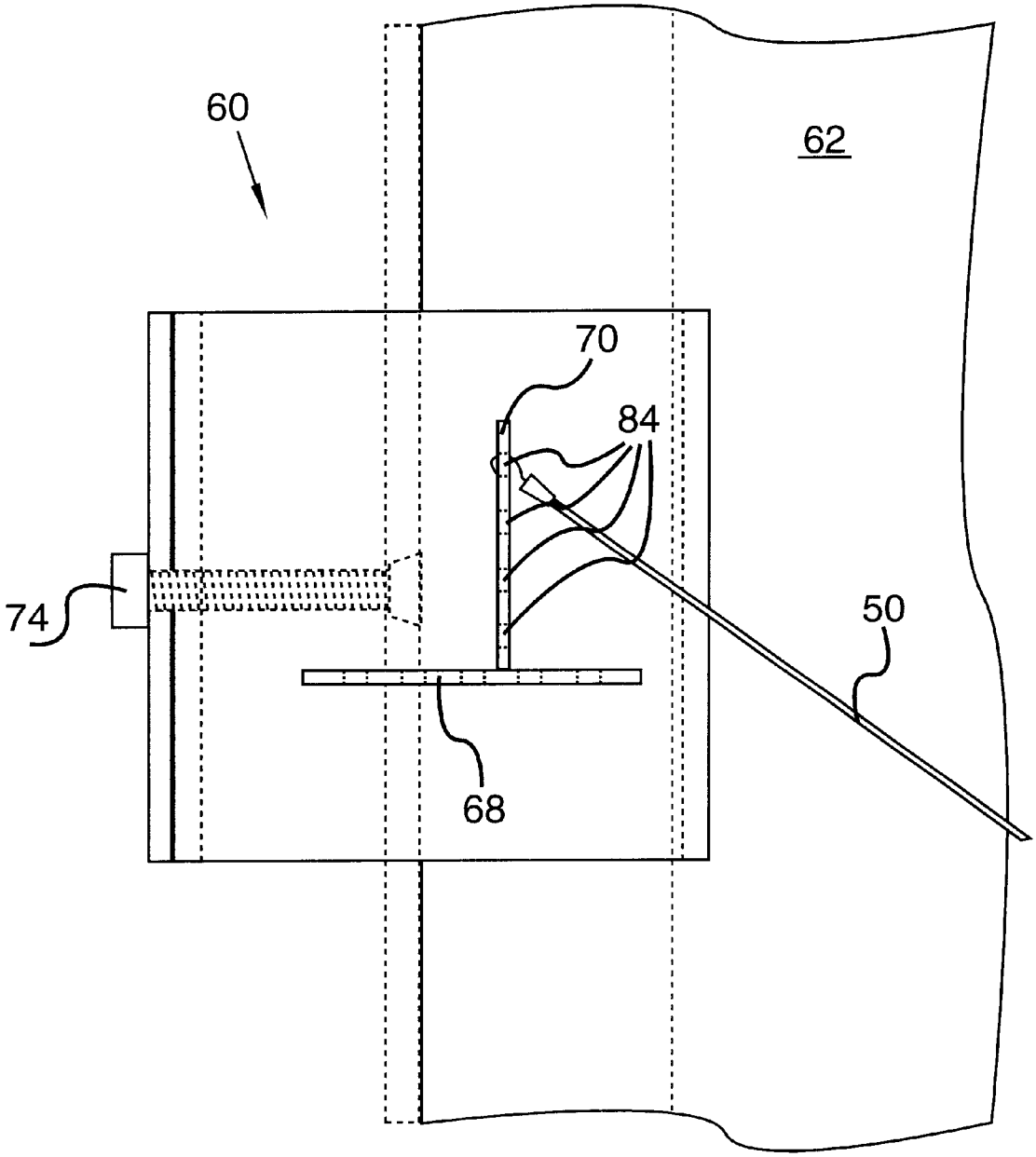
FIG. 5 is a side view of the attachment mechanism of FIG. 4.
Figure 6:
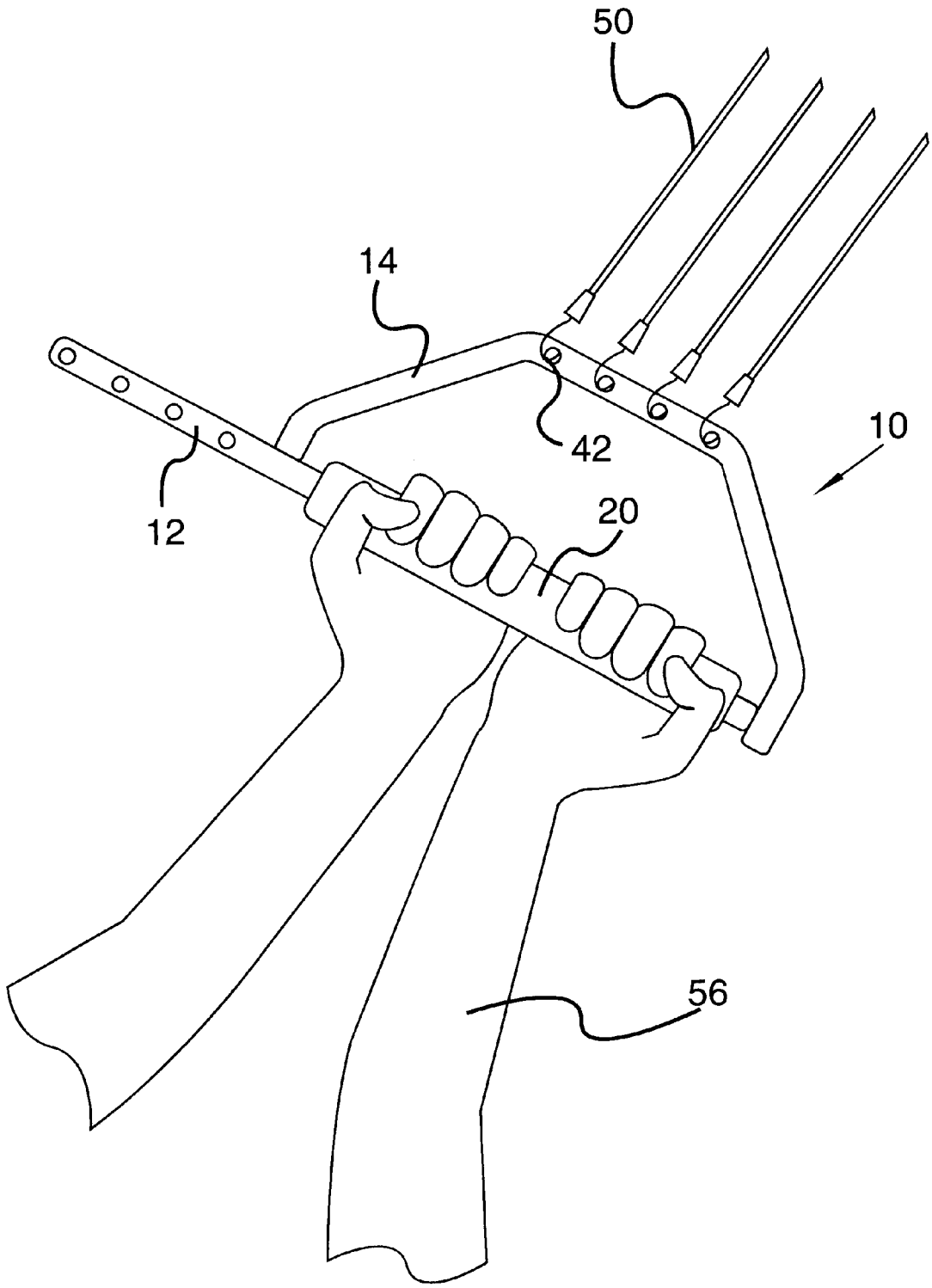
FIG. 6 is a perspective view of the swing device portion being used in an alternate way.

Referring now to FIG. 5, a side view of attachment mechanism 60 shows vertical attachment bar 70 with vertical attachment apertures 84. In the embodiment shown in FIG. 5, attachment mechanism 60 includes two width adjusters 72, one above the other. Tightener 74 is located between width adjusters 72 and substantially on the same vertical line. Vertical attachment bar 70 may be oriented as shown with vertical wall attachment apertures 84 aligned with the long axis of tightener 74, or it may be rotated 90 degrees from the pictured orientation such that vertical wall attachment apertures 84 are centered about an axis extending substantially perpendicularly away from wall 62.

Referring to FIG. 6, four elastic bands 50 are attached to training device 10 at training device apertures 42 located in second rod 14. A user grasps grip 20 with both arms 56 and develops muscle size, strength, and flexibility by alternately flexing and relaxing the muscles as he or she pulls training device 10 away from wall 62 (not shown in this figure) and then allows elastic bands 50 to pull training device 10 back towards wall 62. The exercise pictured in FIG. 6 is just one of many possible exercises that may be performed with training device 10 set up as shown with elastic bands 50 attached to apertures 42. For example, the user's grasp may be changed so that training device 10 is grasped from above with the palms of the hands facing the other direction.

While the invention has been particularly shown and described with reference to certain embodiments thereof, it will be understood by those skilled in the art that various changes in form and details may be made therein without departing from the spirit and scope of the invention. For example, it will be understood that the materials used to construct training device 10 and attachment mechanism 60 may be altered to conform to various considerations such as price and durability. The configuration of the first and second rods may be altered, as well as the location and number of the attachment apertures. These general examples are offered for illustrative purposes, and are representative of all such changes that may be made to the foregoing description without exceeding the scope of coverage intended.

I claim:

1. A muscle training and development device comprising:

a first rod having a first plurality of apertures through said first rod;

a second rod having a second plurality of apertures through said second rod, said second rod further having a plurality of sections, said second rod being attached to said first rod such that said first and second rods define a space between them; and a grip attached to said first rod along at least a portion of said first rod defining the space between said rods wherein said first rod and said second rod are attached at first and second connection points, said first rod having through holes extending through said first rod having a through hole extending through said first rod at said first connection point and a receiving hole extending into said first rod at said second connection point and wherein said second rod includes a receiving hole extending into a first section of said second rod and a through hole extending through a fifth section of said second rod, said respective through holes and receiving holes each capable of receiving a fastening device to secure said first rod and said second rod to one another at said first and second connection points.

2. The training device of claim 1 wherein said first rod comprises a substantially straight piece of metal having a first end and a second end.

3. The training device of claim 2 wherein said first plurality of apertures are located at said first end of said first rod.

4. The training device of claim 1 wherein said plurality of sections of said second rod comprise substantially straight pieces of metal that transition from one section to the next forming elbows.

5. The training device of claim 4 wherein said second rod comprises five continuous sections, said first and said fifth section being substantially perpendicular to said first rod and extending outwardly therefrom in a spaced apart relationship, a second and a fourth section being connected to said first and fifth sections, respectively, said second and fourth sections being angled toward each other, and a third section being substantially parallel to said first rod, said third section connecting said second and fourth sections.

6. The training device of claim 4 wherein said second plurality of apertures are located in said third section of said second rod.

7. The training device of claim 1 wherein said grip slides along said first rod between said first and second connection points and strikes said first sections of said second rod, producing an audible click thereby.

8. The training device of claim 7 wherein said audible clicks are produced upon the proper performance of particular training motions by the user of said training device.

9. The training device of claim 1 further comprising at least one elastic tube, said elastic tube having a first end and a second end, and an attachment mechanism, said attachment mechanism having a plurality of attachment apertures to selectively receive said second end of said elastic tube, said first end of said elastic tube being selectively attachable to said first plurality of apertures in said first rod and said second plurality of apertures in said second rod.

10. The training device of claim 9 wherein said elastic tube includes a hooking device on said first and second ends.

11. The training device of claim 9 wherein said attachment mechanism comprises a first attachment location and a second attachment location, said first attachment location including a first plurality of attachment apertures, said second attachment location including a second plurality of attachment apertures, said first and second plurality of attachment apertures capable of receiving said second end of said elastic band.

12. The training device of claim 11 wherein said first plurality of attachment apertures are arranged in a substantially vertical column and said second plurality of attachment apertures are arranged in a substantially horizontal row, said substantially vertical and horizontal directions being determined with respect to level ground.

13. A muscle training and development device comprising: a first rod having a first end and a second end and a second rod having first, second, third, fourth, and fifth sections, said first rod having a first plurality of apertures in said first end and said second rod having a second plurality of apertures in said third section, said second rod being removably attached to said first rod at first and second connection points, said first and second rods defining a space between them; a grip slidably attached over said first rod so as to rotate freely between said first and second connection points, wherein said grip slides along said first rod between said first and second connection points and strikes said first and fifth sections of said second rod, producing an audible click thereby; at least one elastic tube, said elastic tube having a first end and a second end, said first and second ends attached to a hooking device; and an attachment mechanism, said attachment mechanism including a first attachment location and a second attachment location, said first attachment location including a first plurality of attachment apertures, said second attachment location including a second plurality of attachment apertures, said first and second plurality of attachment apertures capable of receiving said second hooked end of said elastic band.

14. The training device of claim 13 wherein said grip produces said audible click upon the proper performance of particular training motions by the user of said training device.

15. A muscle training and development device comprising a handle having a grip adapted to be grasped by a user, said grip slidably attached to said handle, said grip creating a sound as it slides to a first position and creating a similar sound as it slides to a second position, said grip reaching said first position when a user places his arms and hands in a first posture, said grip reaching said second position when a user places his arms and hands in a second posture, said first and second postures being postures used in a proper golf swing.

* * * * *